US007381306B2

(12) United States Patent
Best et al.

(10) Patent No.: US 7,381,306 B2
(45) Date of Patent: Jun. 3, 2008

(54) PAPER MACHINE BELT

(75) Inventors: Walter Best, Duren (DE); Christian Molls, Aachen (DE)

(73) Assignee: Heimbach GmbH & Co, Duren (DE)

( * ) Notice: Subject to any disclaimer, the term of this patent is extended or adjusted under 35 U.S.C. 154(b) by 454 days.

(21) Appl. No.: 11/076,866

(22) Filed: Mar. 11, 2005

(65) Prior Publication Data

US 2005/0211406 A1 Sep. 29, 2005

(30) Foreign Application Priority Data

Mar. 12, 2004 (EP) ..... 04005978

(51) Int. Cl.
*D21F 1/10* (2006.01)
*D21F 7/10* (2006.01)

(52) U.S. Cl. ..... 162/348; 162/358.2; 162/900; 162/903; 162/904; 428/58

(58) Field of Classification Search ..... 162/116, 162/117, 199, 205–207, 348, 358.2, 900, 162/902–904; 139/383 A, 425 A, 383 AA; 245/10; 28/110, 142; 428/58, 192–194; 24/33 R See application file for complete search history.

(56) References Cited

U.S. PATENT DOCUMENTS

| | | | | |
|---|---|---|---|---|
| 926,004 | A * | 6/1909 | Keller | 139/383 R |
| 1,807,628 | A * | 6/1931 | Lindsay | 245/10 |
| 2,077,891 | A | 4/1937 | Milnes | |
| 2,158,007 | A * | 5/1939 | Ellis, III et al. | 24/33 C |
| 3,309,790 | A | 3/1967 | MacBean | |
| 3,436,041 | A * | 4/1969 | Haller | 245/10 |
| 3,972,105 | A | 8/1976 | Miller et al. | |
| 4,344,209 | A | 8/1982 | Harwood | |
| 4,574,435 | A | 3/1986 | Luciano et al. | |
| 4,896,702 | A * | 1/1990 | Crook | 139/383 A |
| 5,148,838 | A | 9/1992 | Lee | |
| 5,707,496 | A * | 1/1998 | Johnson et al. | 162/348 |
| 6,065,505 | A * | 5/2000 | Fickers | 139/383 AA |
| 6,267,068 | B1 * | 7/2001 | Fickers et al. | 112/440 |

FOREIGN PATENT DOCUMENTS

| | | |
|---|---|---|
| DE | 2 256 244 | 11/1972 |
| DE | G 92 11 776.7 | 9/1992 |
| EP | 0 185 907 | 11/1985 |

(Continued)

*Primary Examiner*—Eric Hug
(74) *Attorney, Agent, or Firm*—Berenato, White & Stavish

(57) ABSTRACT

The invention concerns a paper machine belt having front ends (6, 7) extending transversely to the machine direction and having a yarn structure (2, 4) made up of longitudinal yarns (3) extending in the machine direction and transverse yarns (5) extending transversely to the machine direction, and having a coupling device (8, 32, 52, 62, 72, 82, 92) connecting or capable of connecting the front ends (6, 7), which device comprises at both front ends (6, 7) coupling elements (9, 10; 33, 34, 35, 36; 53, 54; 63, 64: 83, 84; 93, 94) engaging respectively onto the yarn structure (2, 4); which is characterized in that the coupling elements (9, 10; 33, 34, 35, 36; 53, 54; 63, 64; 83, 84; 93, 94) are propping themselves against the side facing away from the front edges (6, 7) transverse yarns (5) belonging to the yarn structure (2, 4).

34 Claims, 6 Drawing Sheets

FOREIGN PATENT DOCUMENTS

| | | | |
|---|---|---|---|
| EP | 0 564 436 | | 3/1993 |
| EP | 1 357 223 | | 4/2002 |
| EP | 1 359 251 | | 4/2002 |
| EP | 1 359 252 | | 4/2002 |
| EP | 1 357 224 | A2 | 4/2003 |
| EP | 1 357 224 | A3 | 4/2003 |
| EP | 04005978.4 | | 3/2004 |
| EP | 04005978.4-2314 | | 7/2004 |
| GB | 2 231 838 | | 11/1990 |
| WO | WO 96/34146 | * | 10/1996 |

* cited by examiner 45
42
46
47

46
47
3
42
41
5
40
36
35
46
38
7
34
44
43
32
37
47
33
6
39
40
35
4
5
5
4
3
3
2
31
2

PAPER MACHINE BELT

CROSS-REFERENCE TO RELATED APPLICATIONS AND CLAIM TO PRIORITY

This application claims priority pursuant to 35 U.S.C. § 119 to application number 04 005 978.4, filed Mar. 12, 2004 before the European Patent Office, the disclosure of which is incorporated herein by reference.

FIELD OF THE INVENTION

The invention concerns a paper machine belt having front ends extending transversely to the machine direction and having a yarn layer having at least one longitudinal yarn layer and one transverse yarn layer, the longitudinal yarns being interconnected to the transverse yarns at the intersection points; and having a coupling device connecting or capable of connecting the front ends, which device comprises at both front ends coupling elements engaging respectively onto the yarn structure.

BACKGROUND OF THE INVENTION

Long, wide belts that circulate in the paper machine and support the paper webs are used in paper machines. These belts are usually textile felts or cloths that comprise as their basis a yarn structure, for example a woven or knitted fabric. Instead of a yarn structure of this kind, it is also possible to provide yarn layers having at least one ply of longitudinal yarns and at least one ply of transverse yarns intersecting the longitudinal yarns, the longitudinal and transverse yarns being interconnected at the intersection points by means of adhesive material, positive engagement, and/or fusing (EP 1 357 223 A1; EP 1 359 252 A1; EP 1 359 251 A1).

For use in the sheet-forming region and the dryer section of a paper machine, the paper machine belt comprises the yarn structure as such. For use in the press section of a paper machine, one or more fiber layers are needle-felted onto the yarn structure.

In many cases the paper machine belts are not endless, but rather are manufactured in a specific length. The front edges at the ends are then, prior to insertion into the paper machine or even in the paper machine itself, interconnected via a seam. The so-called pintle wire seam has proven particularly successful in this context. With this seam, coupling elements having a plurality of coupling eyelets are provided on the mutually facing front edges of the belt, and for closure are made to overlap with one another in such a way that they engage in comb fashion into one another and a continuous passage extending in the transverse belt direction is formed. A pintle wire is then slid into this continuous passage and connects the two front edges in the manner of a hinge.

A variety of systems are known for embodying the coupling eyelets. For example, the coupling eyelets can be formed by looping back the end regions of the paper machine belt (U.S. Pat. No. 2,077,891; U.S. Pat. No. 3,309,790). Individual yarns can also be looped back and woven back in (U.S. Pat. No. 5,148,838).

As an alternative to this, the coupling eyelets can be formed by U-shaped clamps that hook into the ends of the paper machine belt. The seams produced with the aid of such coupling eyelets are referred to as clipper seams (DE-A-2 256 244; U.S. Pat. No. 4,344,209). It is additionally known to form each of the coupling eyelets by way of a U-shaped sheet-metal part, the limbs of each sheet-metal part being connected to the associated front edge of the belt (U.S. Pat. No. 3,972,105). A plurality of cutouts are shaped into the sheet-metal parts, so that coupling projections having coupling eyelets are created.

Another alternative is to form coupling eyelets by way of coupling coils respectively secured onto the front edges (DE-A-2 256 244, U.S. Pat. No. 4,477,435; EP 0 158 907 B1; EP 0 564 436 A1). Connection of the coils to the end faces of the paper machine belt occurs either by means of special seam yarns or by way of the longitudinal yarns of the yarn structure, by the fact that the latter loop around the coils and are woven back. Yarns or wires around which the longitudinal threads are laid can be placed into the coils (DE-A-2 256 244, FIG. 8*e*; EP 0 185 907 B1, FIG. 10).

Also known as coupling elements forming coupling eyelets, instead of coupling coils, are special shaped parts made of plastic that are respectively connected to the longitudinal yarns of the paper machine belt (WO 96/34146; DE-A-199 44 864; GB-A-2 231 838). The longitudinal yarns are looped back and, as a rule, woven back in for that purpose. Transverse wires, which reinforce the shaped parts or around which the longitudinal yarns are laid, can be placed into the shaped parts (DE-A-199 44 864, FIGS. 1 and 6).

For paper machine belts of the species having a yarn layer, complementary coupling elements to which coupling members interconnected in hinge fashion are attached have been proposed for connecting the front edges, the connection to the front edges being created via insertion connections with the longitudinal yarns (EP-A-1 357 224). The coupling elements can be embodied as coupling strips that extend over the entire width of the paper machine belt or only a portion of that width, several coupling strips then being provided next to one another. It has been found however, that this type of connection is not strong enough in cases in which the paper machine belt is exposed to large longitudinal forces.

SUMMARY OF THE INVENTION

It is the object of the invention to configure a seam for connecting the front edges of a paper machine belt of the kind cited initially in such a way that it can absorb and transfer large longitudinal forces in the paper machine belt, and is therefore suitable for paper machine belts whose yarn structure is embodied as a yarn layer with mutual connection of the longitudinal and the transverse yarns.

This object is achieved according to the present invention, in that the coupling elements are propped against the sides facing away from the front edges of transverse yarns belonging to the yarn layer. The basic idea of the invention is therefore to allow the coupling elements to engage directly onto the sides facing away from the front edges of the paper machine belt. Depending on the tensile forces to be absorbed, the support can be provided in each case by way of one, but also several transverse yarns. It has been found that a high-strength connection between the front edges of the paper machine belt and the coupling device is produced in this fashion, so that with appropriate dimensioning of its individual parts, the coupling device can absorb large tensile forces.

The longitudinal and transverse yarns should lie on one another in planar fashion at the intersection points, so that a good connection can be created, for example, by means of adhesive or by mutual fusion. It is particularly advantageous for this purpose if the longitudinal and transverse yarns are embodied as flat yarns in which the width of the yarns is a multiple of the thickness of those yarns. The longitudinal and/or transverse yarns can form multiple plies, i.e. even more than two plies, one ply of longitudinal yarns being in contact in each case against a ply of transverse yarns.

As already mentioned, the coupling elements can each be supported not only on one but on several transverse yarns, usefully two or three transverse yarns, the transverse yarns desirably being adjacent. Support can also occur on the transverse yarn adjacent to the front edge of the belt.

The coupling elements can each extend continuously over the entire width of the paper machine belt. Provision can also be made, however, for several coupling elements to be arranged next to one another in the transverse direction at one front edge, in which context the extension of the coupling elements proceeds over at least one longitudinal yarn, or can also encompass several longitudinal yarns.

Particularly good support of the coupling elements on the transverse yarns is achieved if the coupling elements are supported on the transverse yarns in the intersection region with the longitudinal yarns. This applies in particular to the case in which the longitudinal and transverse yarns are immovably interconnected in the intersection region, for example by welding, adhesive bonding, or positive engagement. In this fashion, forces are directed via the transverse yarns directly into the longitudinal yarns. The coupling elements can comprise for this purpose one or more longitudinal struts that extend in interstices between each two longitudinal yarns, the transverse strut(s) each being in contact against a side of the respective transverse thread that faces away from the front edge. If the coupling elements each comprise several longitudinal struts, the longitudinal struts should be interconnected by way of the transverse struts.

The number of longitudinal struts can be adapted to the particular requirements. Longitudinal struts need not extend in each interstice. It is useful, however, if the longitudinal struts border on both sides at least one longitudinal yarn, or better several longitudinal yarns, so that they are aligned by the longitudinal yarns. In the latter case it is useful if the longitudinal struts completely fill up the interstices between the longitudinal yarns. In addition, the longitudinal struts can also comprise a transverse strut on the side facing toward the front edge of the transverse yarn adjacent to that front edge, so that they border that transverse yarn on both sides.

As regards the coupling elements themselves, in the interconnected state they should constitute at least one articulation having an articulation axis parallel to the front edges, so that the paper machine belt can be guided even over rollers having a small diameter. Particularly suitable for this are hinge articulations, for example comprising a coupling wire and coupling eyelets that surround the coupling wire and are embodied on the coupling elements. The coupling eyelets can have a variety of shapes, for example such as those known from the existing art described above.

As an alternative thereto, provision can be made for a coupling member of one coupling element and an adjacent coupling member of the oppositely located coupling element to form respective member pairs that are inserted in hinge-like fashion into one another, the one coupling member of a member pair comprising a peg that fits into a complementary recess in the other coupling member of that member pair. Advantageously, the pegs are snap-locked into the recesses in such a way that the coupling members are pivotable with respect to one another in hinge-like fashion, but are not axially displaceable with respect to one another (cf. the coupling device shown in FIGS. 4 and 5 of EP 1 357 224 A2 and disclosed in the associated description).

A further alternative for articulated connection consists in configuring, in one articulation axis, a plurality of articulations that each comprise a coupling link and a coupling hook that fits, behind it. It is particularly advantageous in this context if the coupling hooks are embodied as snap hooks. These are understood as hooks that are elastically expanded as they are fitted behind the coupling link, and that snap back after latching in place. The coupling links can be formed by the fact that hole- or window-like recesses are formed in the coupling elements.

Instead of hinge-like articulations, it is also possible to use articulations embodied as flexural articulations, especially if the demands placed on the flexibility of the connection are not too great.

It is not necessary for the articulation or articulations to create the connection between the two coupling elements. This is because provision can be made for the articulation(s) constituting an articulation axis to be embodied on the coupling element or elements of one front edge, and for those coupling elements to be connected via connecting means to the coupling elements on the other front edge. An embodiment of this kind can also be provided on the coupling elements of both front edges, so that both coupling elements comprise articulations each having an articulation axis, and the coupling device is particularly flexible as a result. In addition, the connecting means that connect the two coupling elements can also be embodied in articulated fashion, so that a second or third articulation axis is constituted.

Regardless of the embodiment of the articulations and the arrangement of the articulation axes, provision is made according to the invention for at least two adjacently located articulation axes to be embodied by way of corresponding articulations, in order to improve the flexibility of the connection of the two front edges. This can be brought about, for example, by the fact that the coupling elements along each articulation axis constitute a plurality of coupling links that are connected via a hook strip to coupling hooks that fit behind the coupling links, so that two articulation axes are formed. As already described above, the coupling links can be formed by shaping holes or windows into the coupling elements.

Regardless of whether or not the connection is embodied flexibly, the coupling elements can comprise connecting means engaging positively into one another, by way of which the coupling elements on one front edge are connected or connectable to the coupling elements on the other front edge. The connecting means can be embodied on the one hand as a connecting recess and on the other hand as connecting projections fitting into the connecting recesses. The connecting recess can be embodied, for example, as holes or windows, and the connecting projections as connecting hooks or pins.

As an alternative thereto, provision is made for the coupling elements to comprise connecting means embodied as magnets. The magnets can be located next to one another at the ends with connecting surfaces extending perpendicular to the plane of the paper machine belt. The possibility also exists, however, of placing the magnets onto one another so that the connecting surfaces extend in the plane of the paper machine belt.

BRIEF DESCRIPTION OF THE DRAWINGS

The invention is illustrated in more detail, with reference to exemplifying embodiments, in the drawings, in which.

DETAILED DESCRIPTION OF THE INVENTION(S)

Figures 1, 2, 3:
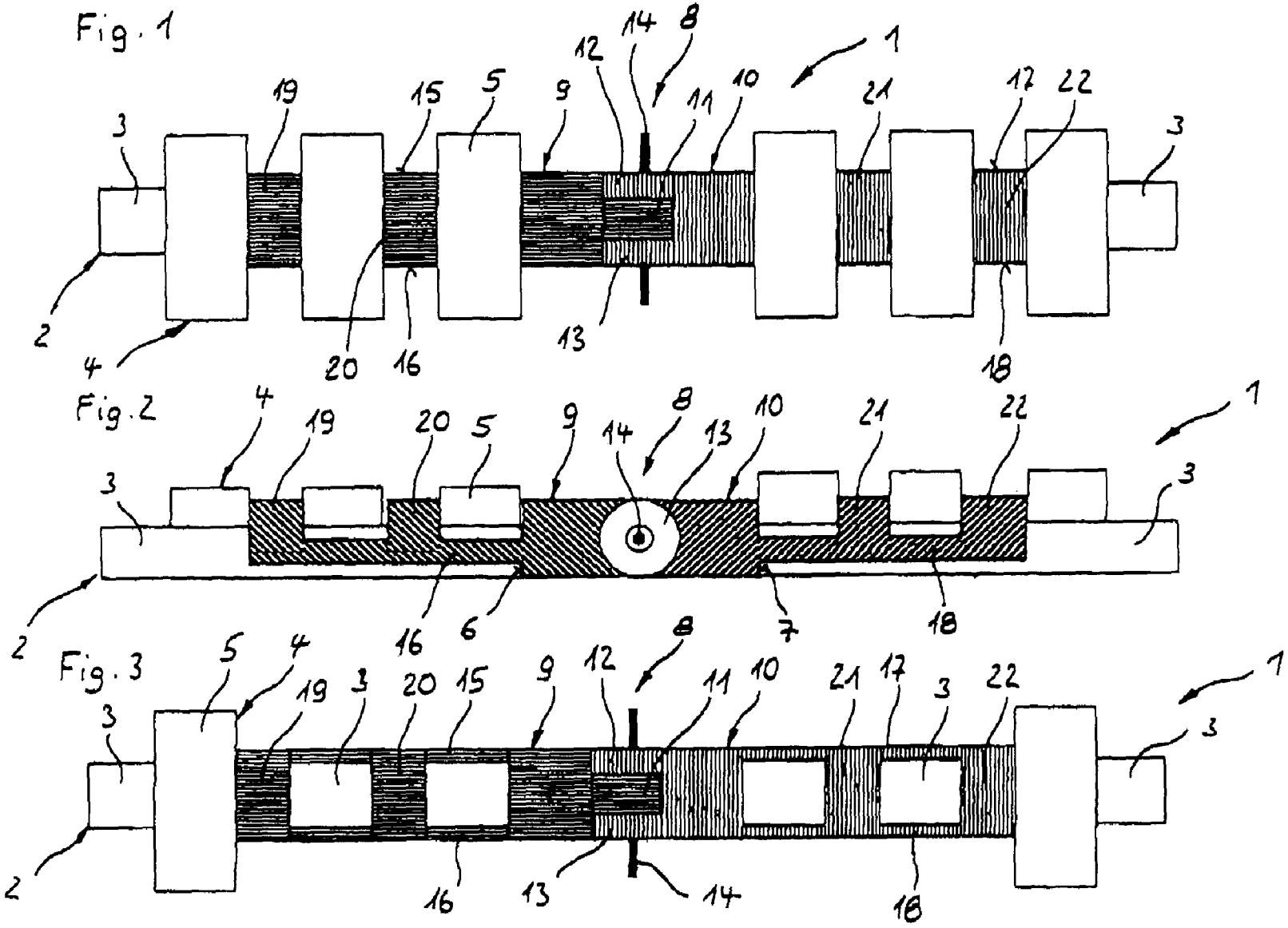
FIG. 1 is a plan view of a portion of a first paper machine belt.
FIG. 2 is a longitudinal section through the portion of a paper machine belt shown in FIG. 1.
FIG. 3 is the plan view according to FIG. 1, but without the four transverse yarns adjacent to the coupling device.
Figures 4, 5, 6, 7:
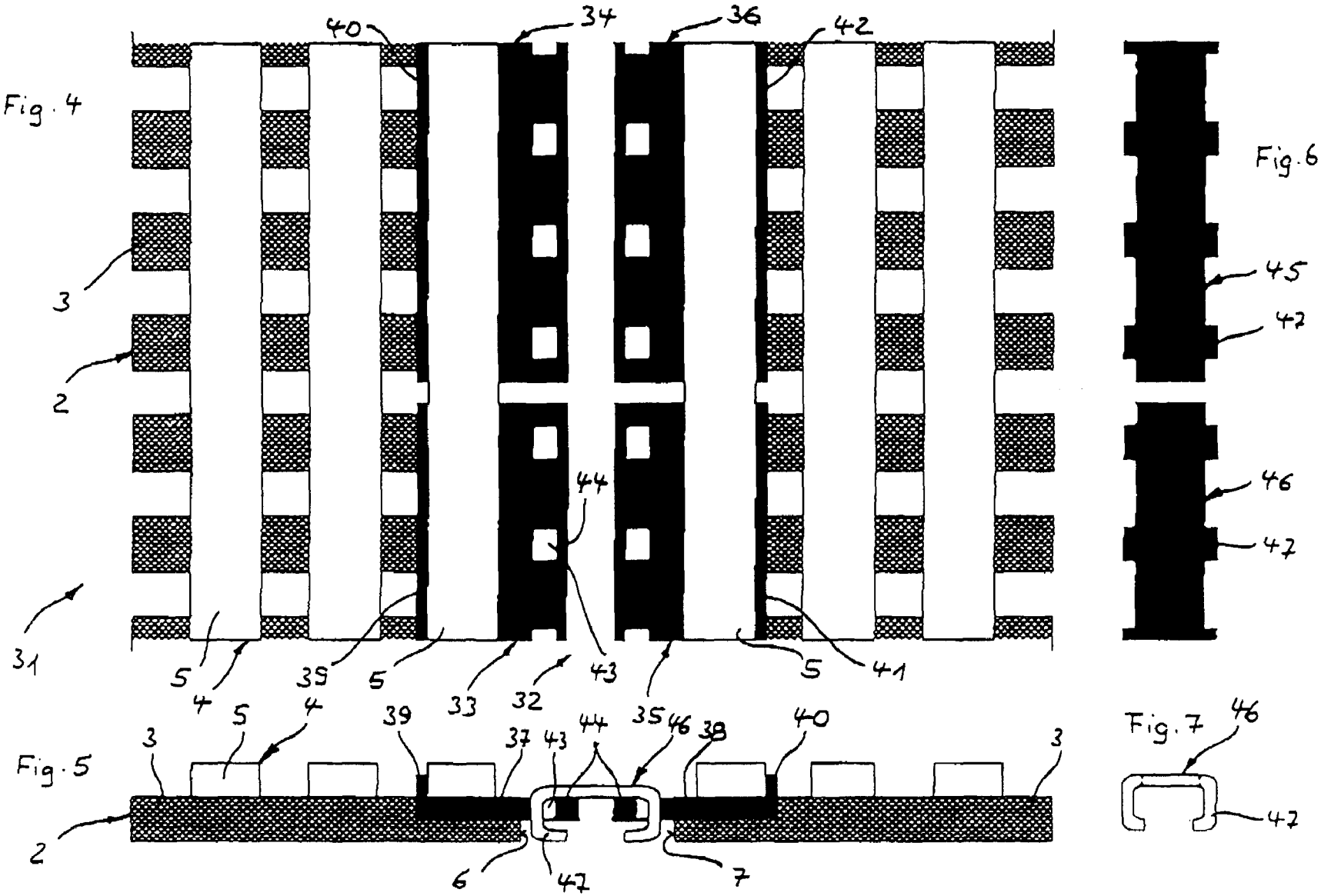
FIG. 4 is a plan view of a portion of a second paper machine belt.
FIG. 5 is a longitudinal section through the portion of a paper machine belt shown in FIG. 4.
FIG. 6 is a plan view of connecting members for the coupling device of the paper machine belt according to FIGS. 4 and 5.
FIG. 7 is an end view of a connecting member according to FIG. 6.

FIGS. 1 through 3 depict portions of the seam region of a first paper machine belt 1. Paper machine belt 1 substantially comprises a yarn lay-up comprising a bottom longitudinal yarn lay-up layer (also referred to herein as longitudinal yarn layer) 2 having a plurality of longitudinal yarns 3 extending in parallel fashion at a distance from one another (of which only one longitudinal yarn 3 is depicted here), and a transverse yarn lay-up layer (also referred to herein as transverse yarn layer) 4 arranged thereon and likewise having a plurality of transverse yarns (labeled 5 by way of example), extending at a distance from one another in parallel fashion, which rest in planar fashion on longitudinal yarns 3 and of which only some are depicted here. Longitudinal and transverse yarns 3, 5 are fused to one another, and thereby immovably connected, at the intersection surfaces. They are made of a thermoplastic, for example PET, PA in all its modifications, PPS, PEK, PEEK, elastic polyester, PBT, or PUT, or combinations thereof. Fusion is accomplished by heating (confined to the intersection surfaces) to the melting temperature and subsequent cooling. The heating can be performed, for example, using a laser.

Paper machine belt 1 has a plurality of longitudinal yarns 3 arranged next to one another in the width direction, longitudinal yarns 3 extending in the machine direction provided for circulation of a paper machine belt in the paper machine. Longitudinal and transverse yarns 3, 5 continue on both sides (although this is not depicted), resulting globally in a sheath-shaped structure of great length and also considerable width. Paper machine belt 1 is finite, i.e. it has exposed front edges 6, 7 that are interconnected via a coupling device 8 so as to result, after the closure of coupling device 8, in an endless paper machine belt 1 suitable for circulation in the paper machine.

In FIGS. 1 through 3 the two front edges 6, 7 have been brought together so they are located opposite one another at their ends. Front edges 6, 7 are constituted by the ends of longitudinal yarns 3, i.e. by longitudinal yarn layer 2, and by transverse yarns 5 respectively adjacent to coupling device 8. The two respectively opposite exposed ends are part of the same longitudinal yarn 3 that extends over the entire length of paper machine belt 1.

Coupling device 8 is formed from a plurality of coupling elements 9, 10, one coupling element 9, 10 being associated with the ends of each longitudinal yarn 3. Coupling elements 9, 10 have a coupling region embodied in hinge-like fashion, where they overlap one another forming a coupling eyelet 11 on left-side coupling element 9, and two coupling eyelets 12, 13, flanking that coupling eyelet 11 on both sides, on right-side coupling element 10. Passing through coupling eyelets 11, 12, 13 is a coupling wire 14 that extends over the entire width of paper machine belt 1 and thus also passes through the coupling elements attached to the other longitudinal yarns (not shown here). Coupling elements 9, 10 are thus connected in hinge-like fashion with an articulation axis extending parallel to front edges 6, 7.

Extending from the coupling region of both coupling elements 9, 10 into the interstices between longitudinal yarns 3 are two longitudinal struts 15, 16, 17, 18 in each case, which respectively border longitudinal yarns 3 on both sides and extend under two transverse yarns 5. The respective pairs of longitudinal struts 15, 16 and 17, 18 are interconnected via two support bridges 19, 20 and 21, 22. These traverse longitudinal yarns 3 in the interstice between each two transverse yarns 5, and almost completely fill those interstices. Support bridges 19, 20 and 21, 22 are in contact against the sides of transverse yarns 5 that respectively face away from front edges 6, 7, and are supported thereon. In the paper machine, tensile forces act on paper machine belt 1 and are absorbed by coupling device 8, the tensile forces being transferred from longitudinal yarns 3 to transverse yarns 5 via the connection at the intersection points, and from there to support bridges 19, 20 and 21, 22 and thus to coupling device 8.

It is understood that coupling elements 9, 10 of several adjacent longitudinal yarns 3 can be grouped together, i.e. can be interconnected by way of corresponding links, so that each coupling element encloses several longitudinal yarns.

Attachment of coupling elements 9, 10 to paper machine belt 1 is accomplished in that firstly the yarn structure made up of longitudinal yarn layer 2 and transverse yarn layer 4 is produced in the manner described in EP 1 359 251 A1, but without the two transverse yarns 5 respectively adjacent to front edges 6, 7, as is evident from FIG. 3. Coupling elements 9, 10 are then placed onto the exposed ends of longitudinal yarns 3 in a manner likewise apparent from FIG. 3, although coupling elements 9, 10 are not coupled to one another, so that front edges 6, 7 can be spaced any desired distance apart. Transverse yarns 5 that are not yet present are then laid over longitudinal yarns 3 into the gaps between support bridges 19, 20, 21, 22, and heated by means of a laser so that they are welded to longitudinal yarns 3 by mutual fusion. Coupling elements 8, 9 are thus attached in loss-proof fashion to the end regions of paper machine belt 1, and coupling elements 9, 10, and thus the end regions, can then be coupled to one another.

The exemplifying embodiments described below deviate from the exemplifying embodiment according to FIGS. 1 through 3 only with regard lo the embodiment of the coupling devices, the coupling devices being identical in terms of their attachment to front edges 6, 7 of paper machine belt 1 except for the slightly different configuration in the case of the exemplifying embodiment according to FIGS. 4 through 7. A repetition below of the description of the details of the respective paper machine belt will therefore be dispensed with, to the extent those details correspond to paper machine belt 1 according to FIGS. 1 through 3. With regard to the reference numbers that have also already been used in FIGS. 1 through 3, the reader is referred to the description above of those reference numbers.

Paper machine belt 31 depicted in FIGS. 4 through 7 comprises a coupling device 32 that is constituted by a plurality of coupling elements 33, 34, 35, 36, of which only four—two for each front edge 6, 7—are visible here, and those only partially. Coupling elements 33, 34, 35, 36 each extend over a plurality of longitudinal yarns 3. As compared with coupling elements 9, 10 in the case of coupling device 8 according to FIGS. 1 through 3, coupling elements 33, 34, 35, 36 comprise longitudinal struts 37, 38 that run in each case only under transverse yarns 5 adjacent to the relevant front edge 6 or 7. On the sides of those transverse yarns 5 facing away from front edges 6, 7, there extends in each case a support strip 39, 40, 41, 42,that spans longitudinal, yarns 3 and by way of which coupling elements 33, 34, 35, 36 are propped against transverse yarns 5. Longitudinal struts 37, 38 completely fill up the interstices between longitudinal yarns 3, except for the mutually opposite end-located longitudinal struts of two adjacent coupling elements 33, 34 and 35, 36.

Coupling elements 33, 34, 35, 36 project beyond front edges 6, 7 in tab-like fashion, and have in that region windows (labeled 43 by way of example) arranged at the center spacing of longitudinal yarns 3, each two windows 43 being located opposite one another in the axis of each longitudinal yarn 3. Articulation links (labeled 44 by way of example) are thereby formed.

Provided for connection of the oppositely located coupling elements 33, 35 and 34, 36 are hook strips 45, 46 that correspond, in their extension transversely to the machine direction of paper machine belt 31, to the extension of coupling elements 33, 34, 35, 36. Hook strips 45, 46 comprise downwardly projecting individual hooks (labeled 47 by way of example) whose width is slightly less than the width of windows 43 and which are bent over horizontally at their free ends (see FIG. 7). Individual hooks 47 have the same spacing as windows 43. As is evident from FIG. 5, individual hooks 47 of hook strips 45, 46 engage, in the installed state, into windows 43, forming two articulation axes passing substantially through articulation links 44. Coupling device 32 is thus characterized by great adaptability even to smaller-diameter reversing rollers.

Figure 8:
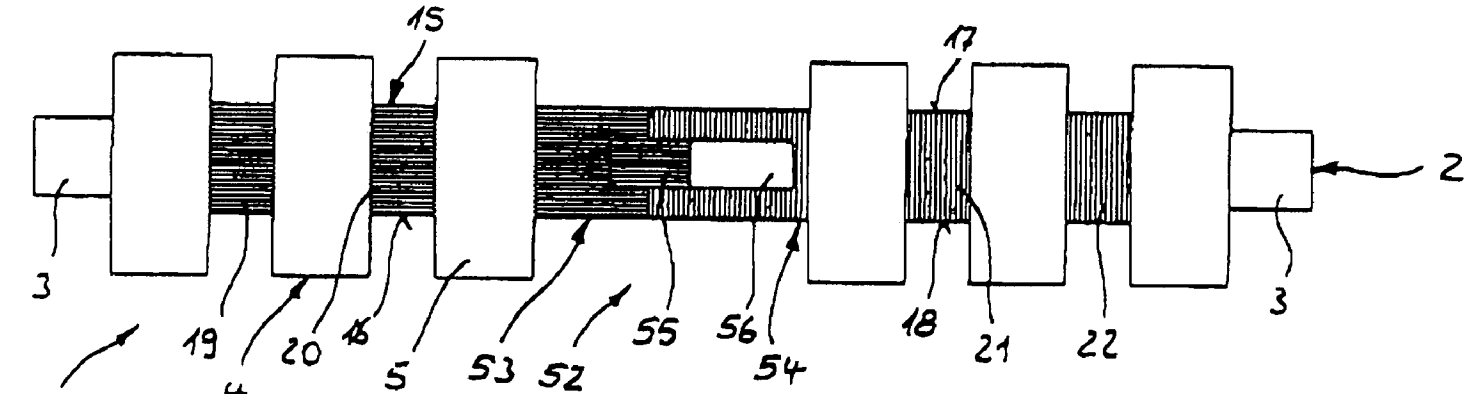
FIG. 8 is a plan view of a portion of a third paper machine belt.
Figure 9:
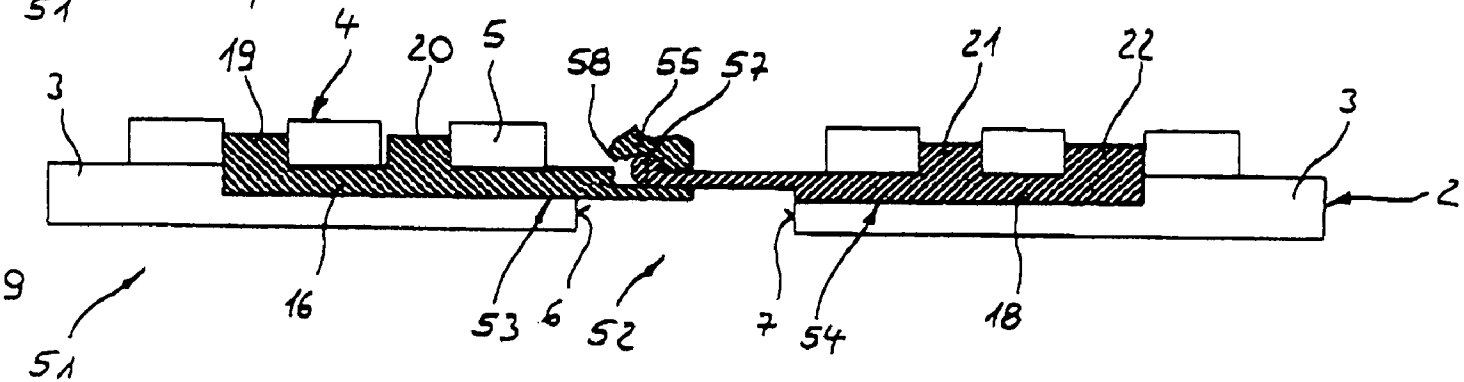
FIG. 9 is a longitudinal section through the portion of a paper machine belt shown in FIG. 8.
Figure 10:
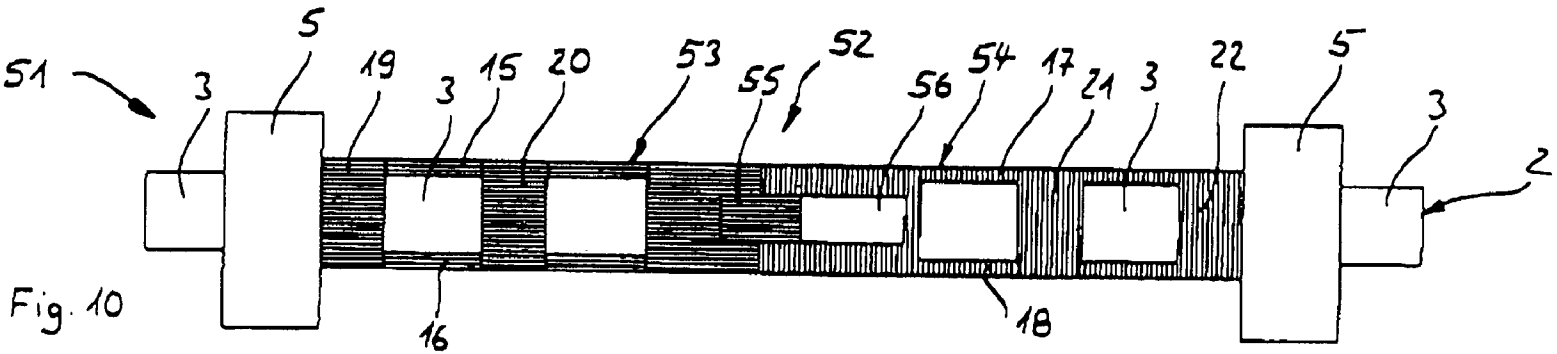
FIG. 10 is a plan view corresponding to FIG. 8, but without the four transverse yarns adjacent to the coupling device.

The exemplifying embodiment according to FIGS. 8 through 10 is depicted in the same fashion as the exemplifying embodiment according to FIGS. 1 through 3. Paper machine belt 51 has a coupling device 52 whose coupling elements 53, 54 are attached to longitudinal yarns 3 in the same manner as in the exemplifying embodiment according to FIGS. 1 through 3, so that the reader is referred in that regard to the description thereof.

The left-side (in this view) coupling element 53 terminates in a coupling hook 55 in the connecting region. Right-side coupling element 54 is embodied in tab-like fashion, and has an elongated rectangular window 56 that is delimited at the exposed edge by an articulation link 57 that is circular in cross section. Articulation segment 57 is enclosed by coupling hook 55, thus forming a hinge-like articulation having an articulation axis that runs through articulation link 57 parallel to front edges 6, 7. Coupling hook 55 is embodied as a snap hook, i.e. the open gap 58 formed by it is narrower than the diameter of articulation link 57, so that as articulation link 57 is latched into coupling hook 55, the latter is elastically expanded and, after latching in, springs back into the position shown.

Figures 11, 12, 13, 14:
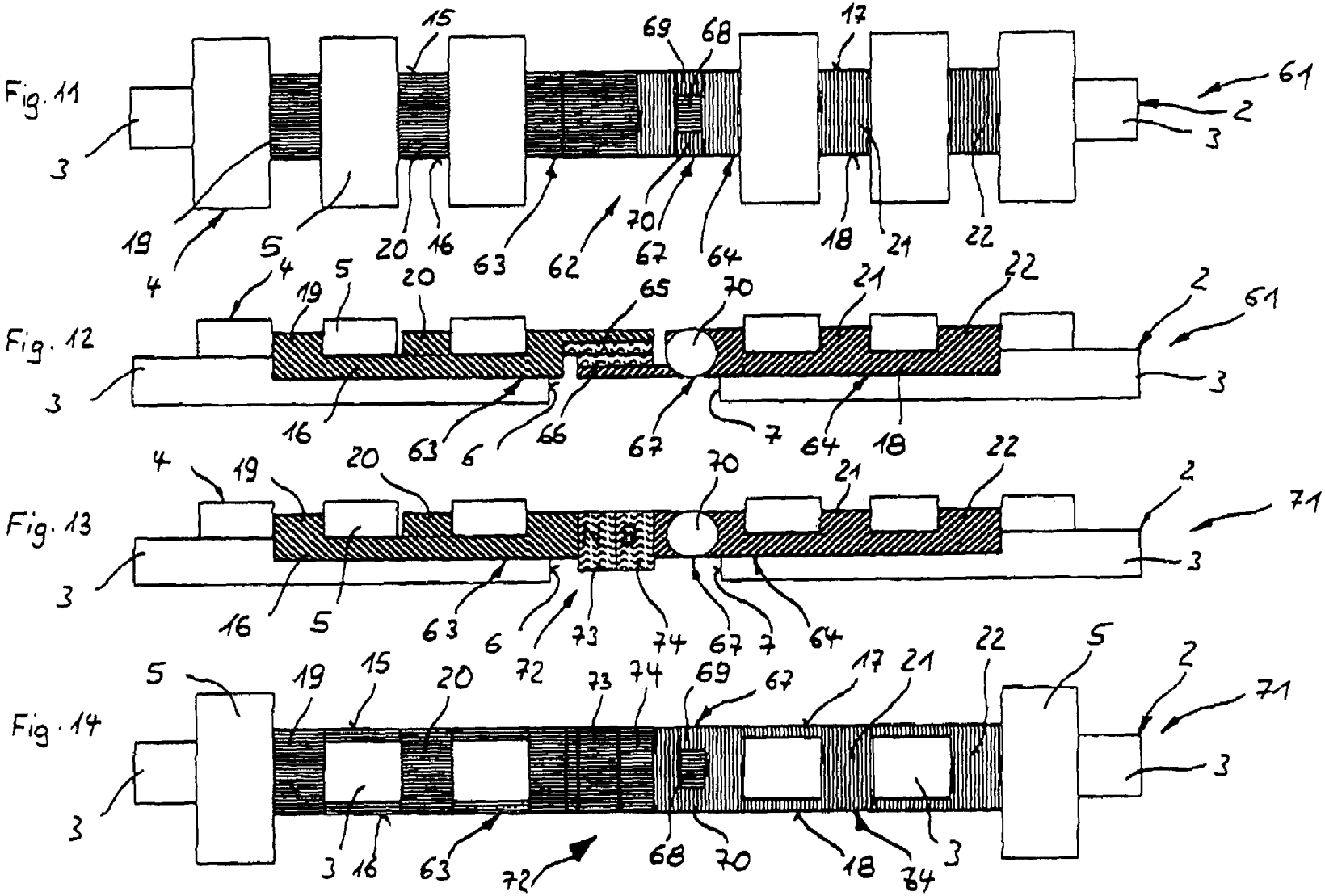
FIG. 11 is a plan view of a portion of a fourth paper machine belt.
FIG. 12 is a longitudinal section through the portion of a paper machine belt shown in FIG. 11.
FIG. 13 is a longitudinal section through a portion of a fifth paper machine belt.
FIG. 14 is a plan view of the portion of a paper machine belt shown in FIG. 13, but without the four transverse yarns adjacent to the coupling device.

FIGS. 11 and 12 depict a paper machine belt 61 in the same manner as in FIGS. 1 through 3. It has a coupling device 62 whose attachment to longitudinal yarns 3 and support on transverse yarns 5 are embodied in the same fashion as in the exemplifying embodiments according to FIGS. 1 and 3 and 8 through 10. The reader is referred in that regard to the former exemplifying embodiment.

Coupling device 62 has coupling elements 63, 64 for each longitudinal yarn 3. They overlap one another in the connecting region, and have mutually attracting magnets 65, 66 on the sides facing one another. Front edges 6, 7 of paper machine belt 61 are interconnected as a result of the attractive force of these magnets 65, 66.

To ensure that the connection is flexible, right-side coupling element 64 is embodied in two parts, the two parts being interconnected by a hinge articulation 67. Hinge articulation 67 comprises an articulation eyelet 68 that is connected to the tab carrying magnet 66, articulation eyelet 68 being flanked by two adjacent articulation eyelets 69, 70. An articulation pin (not depicted here in detail) passes through all three articulation eyelets 68, 69, 70.

FIGS. 13 and 14 depict a paper machine belt 71 whose coupling device 72 differs only in terms of the magnet arrangement, so that for those parts corresponding to paper machine belt 61 according to FIGS. 11 and 12, the same reference numbers are used, the reader being referred to their description above. In the case of coupling device 72, magnets 73, 74 are attached on the end faces of coupling elements 63, 64. They attract one another and thus provide for a connection of coupling elements 63, 64 and therefore of front edges 6, 7 of paper machine belt 71. Here again, a hinge articulation 67 is present that is embodied in the same fashion as in paper machine belt according to FIGS. 11 and 12.

Figure 15:
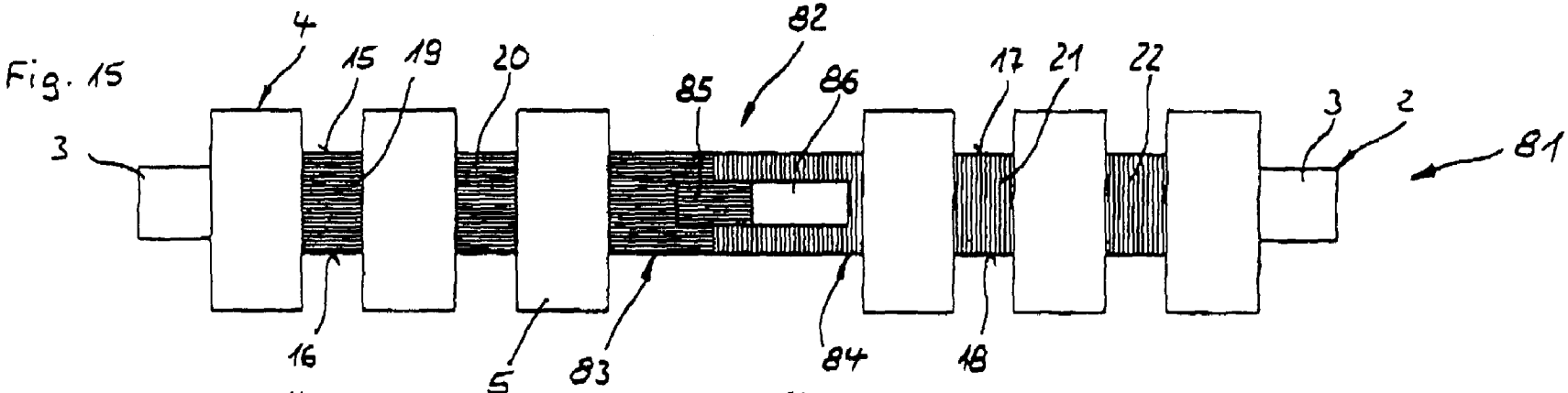
FIG. 15 is a plan view of a portion of a sixth paper machine belt.
Figure 16:
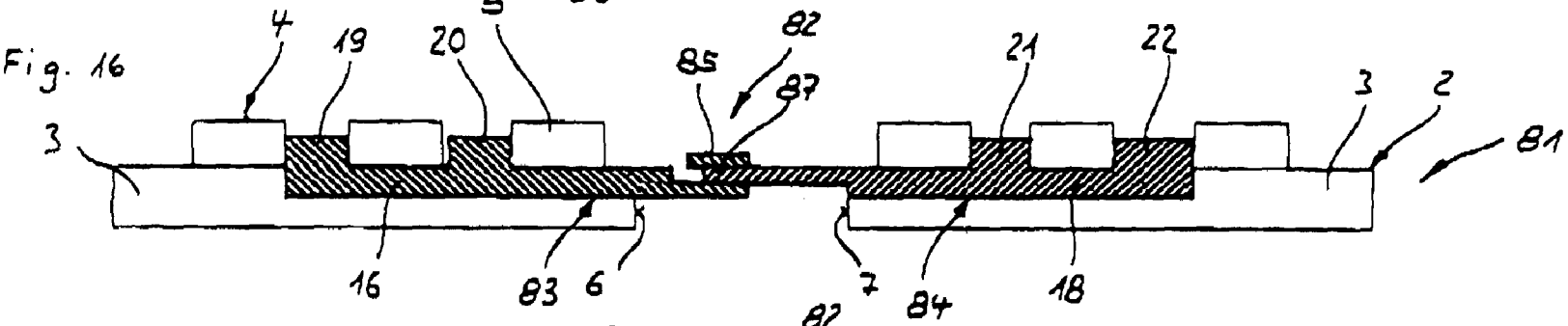
FIG. 16 is a longitudinal section through the portion of a paper machine belt shown in FIG. 15.
Figure 17:
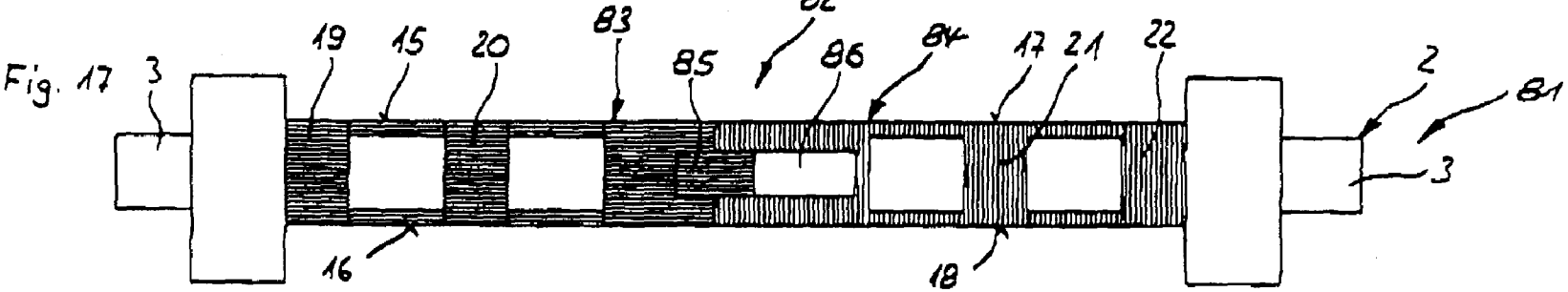
FIG. 17 is a plan view corresponding to FIG. 15, but without the four transverse yarns adjacent to the coupling device.

FIGS. 15 through 17 show a paper machine belt 81 as depicted according to FIGS. 1 through 3. Once again, it differs from that exemplifying embodiment only in terms of the implementation of coupling device 82, and here again only that of the connecting region of its coupling elements 83, 84. Left-side coupling element 83 is embodied as a coupling hook 85 that fits into a window 86 in right-side coupling element 84. In contrast to the embodiment according to FIGS. 8 through 10, coupling hook 85 and link 87 delimiting window 86 are not embodied in articulated fashion. The connection is nevertheless bendable within limits, so that paper machine belt 81 can be used wherever deflection takes place at larger-diameter rollers.

Figure 18:
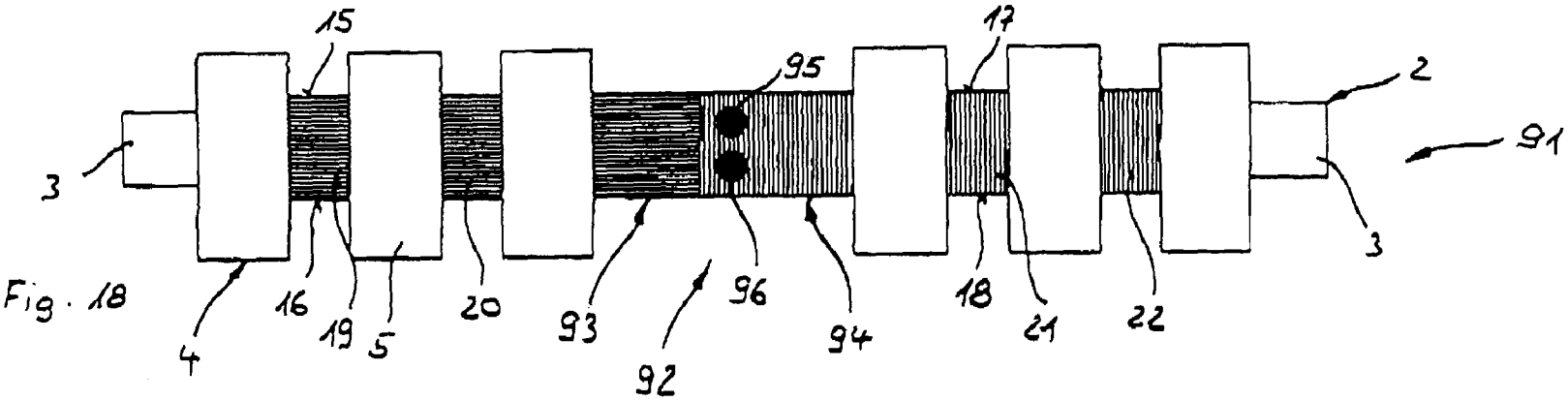
FIG. 18 is a plan view of a portion of a seventh paper machine belt.
Figure 19:
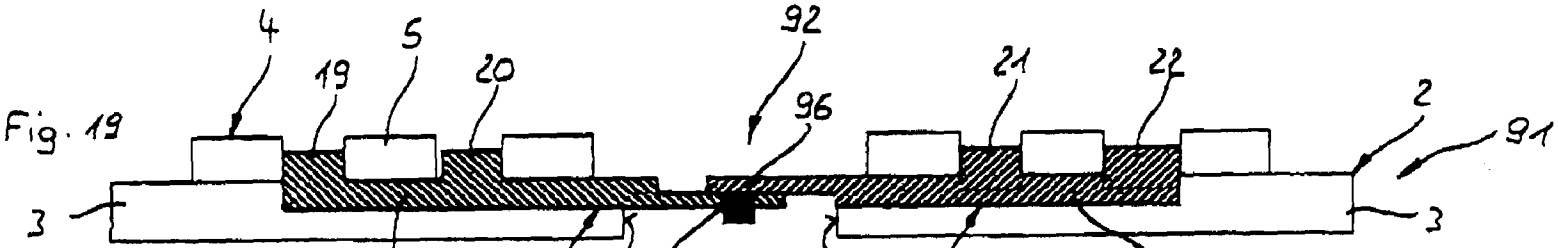
FIG. 19 is a longitudinal section through the portion of a paper machine belt shown in FIG. 18.
Figure 20:
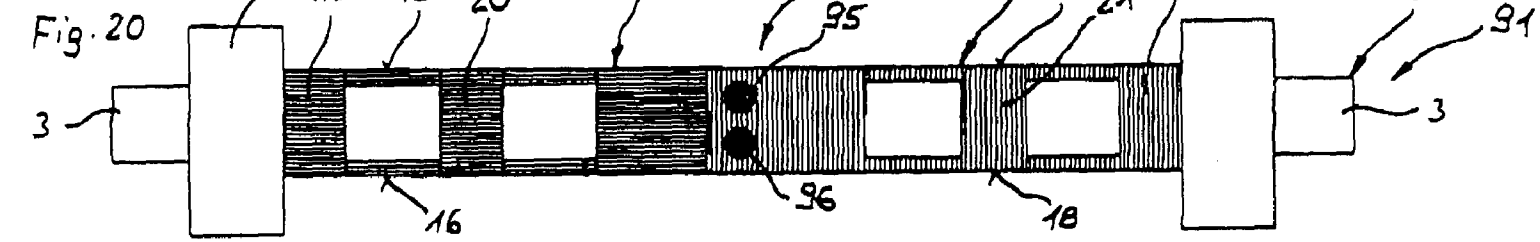
FIG. 20 is a plan view corresponding to FIG. 18, but without the four transverse yarns adjacent to the coupling device.

The same also applies to paper machine belt 91 depicted in FIGS. 18 through 20. Its coupling device 92 has coupling elements 93, 94 that are supported on transverse yarns 5 in the same fashion as in the exemplifying embodiments according to FIGS. 1 through 3 and 8 through 17. Coupling elements 93, 94 overlap one another, the right-side coupling element comprising short coupling studs 95, 96, circular in cross section, that fit positively into matching coupling holes 97 in right-side coupling element 93, and optionally are also latched into place.

We claim:

1. A paper machine belt having front ends extending transversely to the machine direction, the paper machine belt comprising:

a yarn lay-up comprising at least one longitudinal yarn lay-up layer comprising longitudinal yarns; and at least one transverse yarn lay-up layer comprising one or more transverse yarns, the one or more transverse yarns having sides facing away from the front edges, the longitudinal yarns being interconnected to the one or more transverse yarns at the intersection points; and a coupling device connecting or capable of connecting the front ends which coupling device comprises coupling elements engaging respectively the front ends of the yarn lay-up, wherein the coupling elements are propped against the sides facing away from the front edges of the one or more transverse yarns.

2. The paper machine belt as defined in claim 1, wherein the longitudinal and transverse yarns lie on one another in planar fashion.

3. The paper machine belt as defined in claim 2, wherein the longitudinal and transverse yarns are embodied as flat yarns.

4. The paper machine belt as defined in claim 1, wherein the yarn lay-up comprises more than two plies, one ply of the longitudinal yarns being in contact in each case against a ply of the transverse yarns.

5. The paper machine belt as defined in claim 1, wherein the coupling elements are propped against the sides facing away from the front edges of at least two of the transverse yarns.

6. The paper machine belt as defined in claim 5, wherein the transverse yarns against which the coupling element is propped are adjacent.

7. The paper machine belt as defined in claim 1, wherein the coupling elements are propped against the transverse yarn adjacent to the front edge.

8. The paper machine belt as defined in claim 1, wherein several of the coupling elements are arranged next to one another in the transverse direction at one of the front edges.

9. The paper machine belt as defined in claim 1, wherein the coupling elements are propped against the transverse yarns in the intersection region with the longitudinal yarns.

10. The paper machine belt as defined in claim 1, wherein the coupling elements each comprise at least one longitudinal strut that extends in interstices between each two longitudinal yarns and each comprises at least one transverse strut that is or are in contact against a side, facing away from the front edge of the respective transverse thread.

11. The paper machine belt as defined in claim 10, wherein the transverse struts interconnect the longitudinal struts.

12. The paper machine belt as defined in claim 10, wherein the longitudinal struts border at least one of the longitudinal yarns on both sides.

13. The paper machine belt as defined in claim 12, wherein the longitudinal struts border several of the longitudinal yarns on both sides.

14. The paper machine belt as defined in claim 12, wherein the longitudinal struts fill up the interstices between two of the longitudinal yarns.

15. The paper machine belt as defined in claim 10, wherein the longitudinal struts comprise a transverse strut on the side, facing toward the front edge, of the transverse yarn adjacent to that front edge.

16. The paper machine belt as defined in claim 1, wherein in the interconnected state the coupling elements constitute at least one articulation having an articulation axis parallel to the front edges.

17. The paper machine belt as defined in claim 16, wherein the articulation or articulations is or are embodied as (a) hinge articulation(s).

18. The paper machine belt as defined in claim 17, wherein the hinge articulation comprises a coupling wire and coupling eyelets that surround the coupling wire and are embodied on the coupling elements.

19. The paper machine belt as defined in claim 17, wherein in each case a coupling member of one coupling element and an adjacent coupling member of the oppositely located coupling element form member pairs that are inserted in hinge-like fashion into one another.

20. The paper machine belt as defined in claim 19, wherein the one coupling member of a member pair comprises a peg that fits into a complementary recess in the other coupling member of that member pair.

21. The paper machine belt as defined in claim 20, wherein the pegs are snap-locked into the recesses in such a way that the coupling members are pivotable with respect to one another in hinge-like fashion, but are not axially displaceable with respect to one another.

22. The paper machine belt as defined in claim 16, wherein in one articulation axis, there are configured a plurality of articulations that each comprise a coupling link and a coupling hook that fits behind it.

23. The paper machine belt as defined in claim 22, wherein the coupling hook is embodied as a snap hook.

24. The paper machine belt as defined in claim 22, wherein the coupling links are formed by recesses in the coupling elements.

25. The paper machine belt as defined in claim 16, wherein the articulation(s) is or are implemented as (a) flexural articulation(s).

26. The paper machine belt as defined in claim 16, wherein the articulation(s) constituting an articulation axis is or are embodied on the coupling elements of one front edge, and those coupling elements are connected via connecting means to the coupling elements on the other front edge.

27. The paper machine belt as defined in claim 16, wherein the articulations constitute two adjacently located articulation axes.

28. The paper machine belt as defined in claim 27, wherein the coupling elements along each articulation axis constitute a plurality of coupling links that are connected via at least one hook strip to coupling hooks that fit behind the coupling links.

29. The paper machine belt as defined in claim 1, wherein the coupling elements comprise connecting means engaging positively into one another, by way of which the coupling elements on one front edge are connected or connectable to the coupling elements on the other front edge.

30. The paper machine belt as defined in claim 29, wherein the connecting means are embodied on the one hand as connecting recesses and on the other hand as connecting projections fitting into the connecting recesses.

31. The paper machine belt as defined in claim 30, wherein the connecting recesses are embodied as holes and the connecting projections as connecting hooks or pins.

32. The paper machine belt as defined in claim 1, wherein the coupling elements comprise connecting means embodied as magnets.

33. The paper machine belt as defined in claim 32, wherein the magnets are located next to one another at the ends with connecting surfaces extending perpendicular to the plane of the paper machine belt.

34. The paper machine belt as defined in claim 32, wherein the magnets rest on one another with connecting surfaces extending in the plane of the paper machine belt.

* * * * *